US006990795B2

(12) United States Patent
Wortmann et al.

(10) Patent No.: US 6,990,795 B2
(45) Date of Patent: Jan. 31, 2006

(54) YARN FALSE TWIST TEXTURING MACHINE

(75) Inventors: Thomas Wortmann, Remscheid (DE); Frank Springmeier, Wuppertal (DE); Reinhard Lieber, Sprockhövel (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/912,310

(22) Filed: Aug. 5, 2004

(65) Prior Publication Data

US 2005/0011177 A1 Jan. 20, 2005

Related U.S. Application Data

(63) Continuation of application No. PCT/EP03/01486, filed on Feb. 14, 2003.

(30) Foreign Application Priority Data

Feb. 20, 2002 (DE) ..... 102 07 086

(51) Int. Cl.
*D01H 13/32* (2006.01)

(52) U.S. Cl. ..... 57/284; 57/264

(58) Field of Classification Search ..... 57/284–291, 57/332–349, 264, 265; 700/130, 139
See application file for complete search history.

(56) References Cited

U.S. PATENT DOCUMENTS

| | | | |
|---|---|---|---|
| 4,556,809 A | 12/1985 | Beisse et al. | |
| 4,947,634 A | 8/1990 | Stürwald | |
| 5,394,334 A | 2/1995 | Simon | |
| 5,504,381 A * | 4/1996 | Kato | 310/51 |
| 2002/0088218 A1 | 7/2002 | Wortmann et al. | |

FOREIGN PATENT DOCUMENTS

| | | |
|---|---|---|
| DE | 32 29 351 A1 | 2/1984 |
| DE | 33 24 243 A1 | 2/1984 |
| DE | 34 20 371 A1 | 7/1985 |
| DE | 34 29 813 A1 | 2/1986 |
| DE | 38 22 420 A1 | 1/1990 |
| DE | 39 14 473 A1 | 11/1990 |
| DE | 100 26 942 A1 | 6/2001 |
| EP | 0 389 849 A2 | 10/1990 |
| EP | 1 172 469 A1 | 1/2002 |

OTHER PUBLICATIONS

*Natur-wissenschaft und Technik*, VEB F.A. Brockhaus Verlag Leipzig, 1980, outside and inside cover pages and p. 268.

* cited by examiner

*Primary Examiner*—John J. Calvert
*Assistant Examiner*—Shaun R. Hurley
(74) *Attorney, Agent, or Firm*—Alston & Bird LLP

(57) ABSTRACT

A texturing machine for draw texturing a plurality of synthetic multi-filament yarns and which includes a plurality of side by side processing stations. Each of the processing stations comprises a plurality of processing units for advancing, texturing, drawing, and winding the yarn. At least one of the processing units is driven by an electrical individual drive, with the individual drives of the processing units of adjacent processing stations being controlled by a common group frequency changer. To enable a separate connection and disconnection of the individual drives with a simultaneous group control, the electrical individual drive of each processing unit includes an asynchronous unit and a synchronous unit. In the case of a predetermined desired frequency, this permits an automatic startup and maintenance of the desired frequency, which leads to a high degree of uniformity of the yarn treatment in each processing station.

21 Claims, 5 Drawing Sheets

YARN FALSE TWIST TEXTURING MACHINE

CROSS REFERENCE TO RELATED APPLICATION

The present application is a continuation of international application PCT/EP03/01486 filed 14 Feb. 2003 and designating the U.S. The disclosure of the referenced international application is incorporated herein by reference.

BACKGROUND OF THE INVENTION

The invention relates to a texturing machine for draw texturing a plurality of synthetic multi-filament yarns. A texturing machine of this general type is disclosed in DE 100 26 942 A1 and Patent Publication US 2002/0088218A1.

For draw texturing a plurality of yarns, texturing machines of the described type possess a corresponding plurality of side by side processing stations. Each of the processing stations comprises a plurality of processing units, such as, for example, feed systems, false twist texturing units, and takeup devices, which serially advance, texture, draw, and wind the yarn to a package.

To drive the processing units, basically two different variants are known. In a first variant, all processing units of a group, for example, all first feed systems of the processing stations together are synchronously driven by one drive. However, this variant has in general the disadvantage that it does not permit an individual control of the processing stations. To avoid such disadvantage, the above cited documents disclose a variant of the drive, which uses individual drives to drive the processing units within the processing stations. In this process, a group frequency changer activates the individual drives of a group of processing units of adjacent processing stations, such as, for example, all individual drives of the first feed systems. However, it has now been found that the individual activation of the processing stations results in that the individual drives of the processing units are more often connected and disconnected separately from one another. In this connection, it must be ensured that in the operating state, each of the individual drives of a group of processing units have the same operating parameters, for example, drive speed.

It is therefore an object of the invention to further develop a texturing machine of the initially described type in such a manner that even after shutting down certain individual drives, it is always possible to operate the processing units of a functional group of a plurality of processing stations in a certain operating state without requiring a larger number of control systems.

SUMMARY OF THE INVENTION

The above and other objects and advantages of the invention are achieved by providing a texturing machine composed of a plurality of side by side processing stations, and wherein at least one of the processing units of each station is driven by an electrical individual drive. Also, the electric individual drive of the processing unit comprises an asynchronous unit for starting up to a predetermined desired frequency and a synchronous unit for maintaining the predetermined desired frequency.

The invention thus has the advantage that a group frequency changer may be provided which permits activating the individual drives in a simple manner so that only a desired frequency is applied to each individual drive. In this connection, the desired frequency forms the operating state (e.g. rotational speed) that is necessary for the processing unit. In the individual drive, the asynchronous unit sees to it that after starting up, the individual drive starts operating directly until the desired frequency is reached. Upon reaching the desired frequency, the synchronous unit of the individual drive becomes operative and prevents the processing unit from being driven with a frequency that deviates from the desired frequency. The processing unit thus reaches automatically an operating state that corresponds to the desired frequency. With that, it is possible to use a group frequency changer for controlling a plurality of individual drives in a simple manner. After each connection, it is thus possible to operate the processing units of a functional group in the operating state reliably with the respectively predetermined desired parameters. This ensures an identical treatment of all yarns in the processing stations.

The electric individual drives may be constructed both as asynchronous motors and as synchronous motors. In the case that the asynchronous motor forms the asynchronous unit of the individual drive, the asynchronous motor includes a field magnet which forms part of a synchronous unit. The field magnet is formed preferably by a plurality of permanent magnets, which are mounted on the rotor of the asynchronous motor. With that, it is accomplished that the asynchronous motor can automatically maintain the predetermined desired frequency after the acceleration phase. The field magnet ensures that the rotor operates synchronously with the rotating field of the stator of the asynchronous motor. This further development of the invention is suitable in particular for processing units, which require a relatively high starting torque.

It is preferred to form the synchronous unit by a synchronous motor, which comprises as an asynchronous unit an auxiliary winding arranged on the rotor. This ensures that during an activation of the individual drive at a constantly predetermined desired frequency, the synchronous motor starts up without delay, until the rotor of the synchronous motor is in sync with the rotating field of the stator.

To enable an individual startup and shutdown of the processing stations independently of one another, a very advantageous further development of the invention proposes to connect each of the individual drives of the group of processing units to the group frequency changer via a controllable switching element. This makes it possible to shut down one or more of the individual drives associated to the group frequency changer without influencing adjacent individual drives and processing units.

Moreover, it will be of advantage, when each of the individual drives comprises a sensor for monitoring the rotational speed. This sensor connects to a control unit that controls the switching elements. Thus, it is possible to avoid with advantage an overload of the individual drives by a comparison of actual and desired values.

For example, to switch from a threading speed to an operating speed, while threading the yarns in the processing stations, a particularly preferred further development of the invention proposes to connect the control unit and the group frequency changer to an overriding central machine control system.

With the use of a plurality of individual drives for a plurality of processing units, one frequency changer each is associated to the individual drives of a group of processing units, with all group frequency changers being coupled with the machine control system. To increase the flexibility of a texturing machine, a further advantageous embodiment of the invention proposes to divide the plurality of processing stations into one or more sections, with each section comprising a plurality of processing stations. In this case, the group frequency changers of the section connect to a field control system that is connected to the section. The processing units of the processing stations in the particular section can thus be controlled independently of the processing units of the processing stations of adjacent sections.

The processing units driven by individual drives may advantageously be formed for each processing station by a first feed system, and/or a second feed system, and/or a third feed system. This makes it possible to adjust and vary in an accurate manner both the yarn speed and the draw ratio for drawing the yarn.

The group of processing units, which are driven by individual drives, may also include in each processing station a drive roll of a takeup device and/or by a false twist texturing unit.

Basically, all rotatably driven processing units are suited for operating with a substantially predetermined desired frequency while draw texturing the yarns.

BRIEF DESCRIPTION OF THE DRAWINGS

In the following, embodiments of a texturing machine according to the invention are described in greater detail with reference to the attached drawings, in which.

DETAILED DESCRIPTION OF THE PREFERRED EMBODIMENTS

Figure 1:
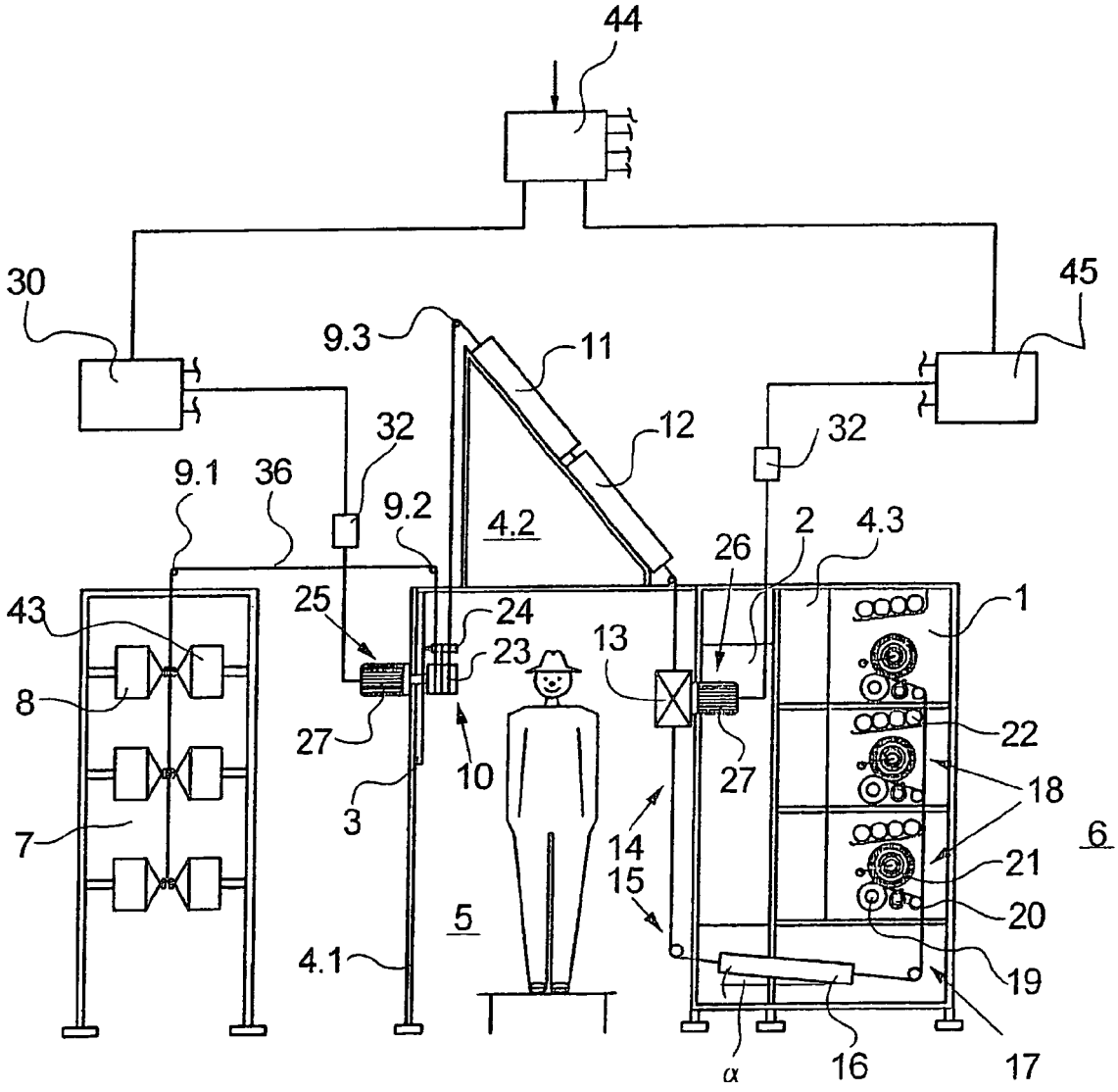
FIG. 1 is a schematic side view of a first embodiment of a yarn texturing machine according to the invention.

FIG. 1 schematically illustrates a first embodiment of a yarn texturing machine according to the invention. The texturing machine comprises a feed module 3, a processing module 2, and a takeup module 1, which are arranged in a machine frame composed of frame sections 4.1, 4.2, and 4.3. The frame section 4.1 mounts the feed module 3, and the frame section 4.3 mounts the processing module 2 and takeup module 1. The frame sections 4.1 and 4.3 are interconnected by frame section 4.2, which is arranged above the feed module 3 and processing module 2. Between the processing module 2 and the feed module 3, a service aisle 5 extends below the frame section 4.2. In the frame section 4.2, the processing module 2 is arranged on the side facing the service aisle 5, and the takeup module 1 on the opposite side thereto.

A doffing aisle 6 is provided along the takeup module 1. In its longitudinal direction (in FIG. 1, the plane of the drawing corresponds to the transverse plane) the texturing machine comprises a plurality of side by side processing stations, one processing station for each yarn. Takeup devices 18 occupy a width of three processing stations. Therefore, three takeup devices 18 are superposed in the takeup module 1 in a column, as will be described in more detail further below.

The view of FIG. 1 shows the processing units of a processing station, which are accommodated respectively in the feed module 3 and processing module 2. Each processing station thus comprises a plurality of processing units 10, 11, 12, 13, 14, 15, 16, 17, and 18, one following the other in the path of an advancing yarn.

A first group of the processing units is formed in each processing station by a first feed system 10, which is mounted to the feed module 3. The adjacent first feed systems of adjacent processing stations are arranged side by side (not shown). A feed yarn package 8 in a creel 7 is associated to each first feed system 10. Next to the feed yarn package 8, the creel 7 of each processing station accommodates a reserve package 43. In each processing station, the first feed system 10 withdraws a yarn 36 via a plurality of yarn deflection guides 9.1 and 9.2.

In the following, the further processing units of a processing station are described with reference to the path of yarn 36. In the direction of the advancing yarn, downstream of the first feed system 10, an elongate primary heater 11 extends, through which the yarn 36 advances. In so doing, the yarn 36 is heated to a predetermined temperature. The primary heater 11 could be constructed as a high-temperature heater, whose heating surface has a temperature above 300° C. In the direction of the advancing yarn, downstream of the primary heater 11, a cooling device 12 is provided. The primary heater 11 and cooling device 12 are arranged in one plane, one following the other, and supported by the frame section 4.2 above the service aisle 5. In the inlet region of the primary heater 11, a deflection roll 9.3 is arranged, so that the yarn 36 crosses the service aisle 5 in the configuration of an inverted V.

On the side of the service aisle 5 opposite to the feed module 3, the frame section 4.3 mounts the processing module 2. In the direction of the advancing yarn, the processing module 2 supports, one below the other, a false twist unit 13, a second feed system 14, and a third feed system 15. In this arrangement, the yarn 36 advances from the outlet of the cooling device 12, which is preferably formed by a cooling rail or a cooling tube, to the false twist texturing unit 13. The false twist texturing unit 13, which may be formed, for example, by a plurality of overlapping friction disks, is driven by a false twist drive 26. The false twist drive 26 is constructed as an individual drive 27, which is likewise arranged on the processing module 2.

The second feed system 14 withdraws the yarn 36 from the false twist zone, which extends between the false twist texturing unit 13 and the first feed system 10. The second feed system 14 and the first feed system 10 are driven at different speeds for drawing the yarn 36 in the false twist zone.

Downstream of the second feed system 14, the third feed system 15 is positioned, which advances the yarn 36 directly into a secondary heater 16. To this end, the secondary heater 16 is arranged on the underside of frame section 4.3 and, thus, below the processing module 2 and takeup module 1. The secondary heater 16 represents the yarn passage from the processing module to the takeup module 1. As a result of integrating in the frame section 4.3, the processing module 2, secondary heater 16, and takeup module 1, a very short yarn path is realized, which is substantially U-shaped. To this end, the underside of the takeup module 1 mounts a fourth feed system 17, which withdraws the yarn 36 directly from the secondary heater 16, and advances it after a deflection to the takeup device 18.

The third feed system 15 and fourth feed system 17 may be driven at different speeds, so as to enable a shrinkage treatment of the yarn 36 within the secondary heater 16. To this end, the secondary heater 16 may comprise a biphenyl-heated contact heater, which is inclined relative a horizontal by an angle α. The angle ranges from 5° to 45°. With that, it is made certain that within a heating channel of the secondary heater 16, the yarn 36 undergoes a uniform heating caused by contact.

In the present embodiment, the takeup device 18 is schematically identified by a yarn traversing device 20, a drive roll 19, and a package 21. The takeup device 18 also includes a tube magazine 22 for performing an automatic package doff. Auxiliary devices that are needed for doffing full packages are not shown in greater detail.

In the present embodiment, the feed systems 10, 14, 15, and 17 are made identical. They are each formed by a godet 23 and a guide roll 24 associated therewith. The godet 23 is driven by a godet drive 25. The guide roll 24 is supported for free rotation, so that the yarn 36 advances over godet 23 and guide roll 24 by looping them several times.

In the embodiment of the texturing machine shown in FIG. 1, the godet drive 25 of the first feed system 10 is constructed as an individual drive 27. The individual drive 27, whose construction is described in greater detail in the following, is coupled with a group frequency changer 30 via a switching element 32. The group frequency changer 30 is likewise associated to adjacent individual drives of adjacent first feed systems in adjacent processing stations not shown. Thus, it is possible to associate, for example, all individual drives of the first feed systems within a texturing machine to a common group frequency changer 30. The group frequency changer 30 connects to a central machine control system 44. Thus, the first feed system 10 represents a first functional group of processing units, which are driven within the machine by individual drives 27.

A second functional group of processing units is formed by the false twist units 13. The false twist drives 26 are likewise constructed as individual drives 27, which are associated to a second group frequency changer 45. Likewise, a switching element 32 is used to connect the individual drives 27 to the second group frequency changer 45, which likewise connects to the machine control system 44.

The drives and drive control of the remaining processing units are not described in greater detail. They could likewise be formed, for example, by individual drives with a control system via group frequency changers or by individually controlled drives.

In operation, the individual drives 27 of the feed systems 10 and false twist units 13 are controlled with a desired frequency that is defined by the machine control system 44, so that the feed system 10 has a certain circumferential speed for advancing the yarn 36, and so that the false twist unit 13 likewise reaches a drive speed that is needed for texturing the yarn. As is known, in the processing station, the yarn 36 is advanced, drawn, textured, and wound to a package 21. In the case that a breakdown occurs in the illustrated processing station, for example, by a yarn break, the switching element 32 separates the individual drives 27 of the feed system 10 and the false twist unit 13 from their respective group frequency changer 30 or 45. The first feed system 10 and the false twist unit 13 are shut down. Adjacent processing stations remain unaffected by this action. The individual drives associated to the group frequency changers 30 and 45 remain in an unchanged operating state.

After eliminating the breakdown in the processing station, a reconnection to the group frequency changers 30 and 45 will occur via the switching elements 32, so that it is again possible to activate the individual drives 27. With that, the desired frequency is applied to the individual drives 27.

Figure 3:
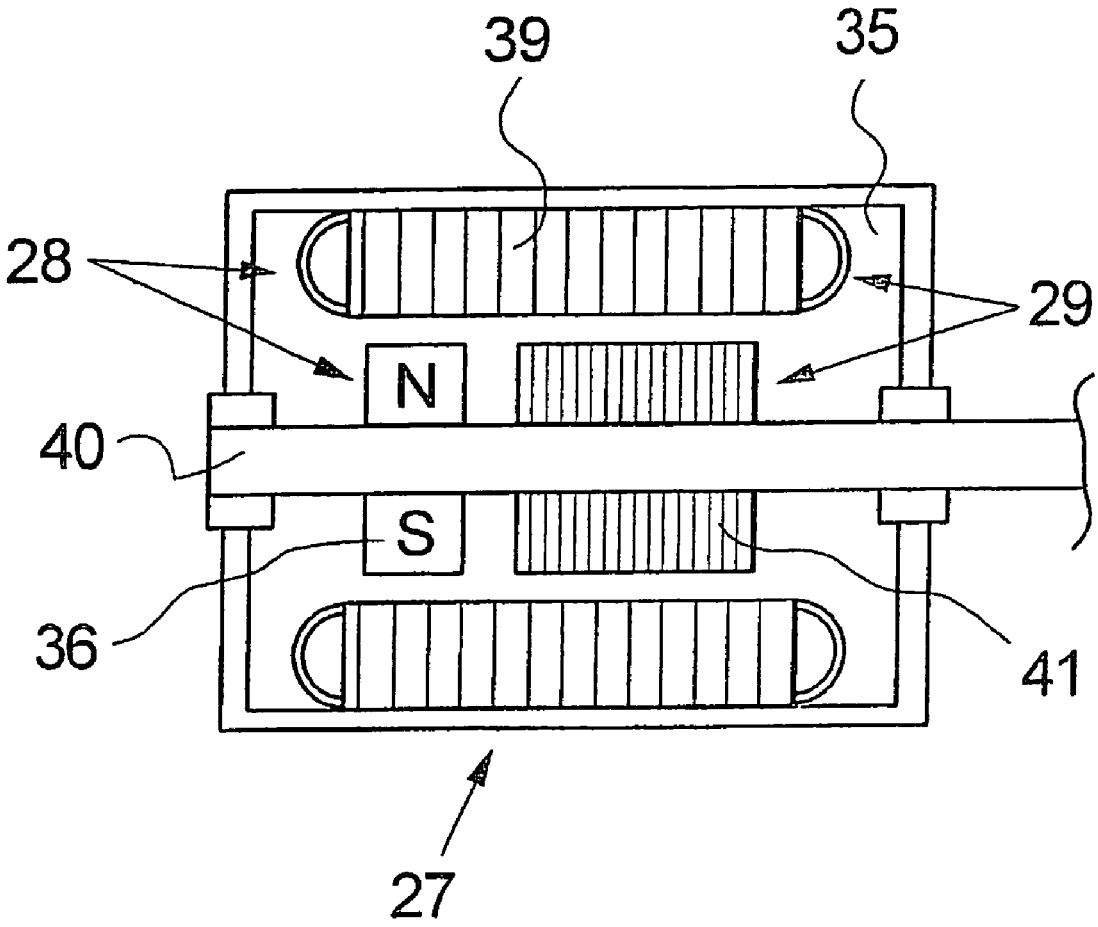
FIG. 3 is a schematic view of an embodiment of an individual drive for a feed system.

To enable the connection and disconnection as well as the startup and continuation in the operating state of the individual drives 27 without requiring a larger number of control means, each individual drive 27 includes a synchronous unit and an asynchronous unit. FIG. 3 illustrates a first embodiment of an individual drive 27, which is constructed as an asynchronous motor 35. The asynchronous motor 35 thus represents the asynchronous unit 29 that comprises a stator winding 39 and a rotor winding 41. To this end, the rotor winding 41 is attached to a rotor 40. Inside the stator winding 39, the rotor 40 mounts a field magnet 36, which represents the synchronous unit 28 together with the stator winding 39. The field magnet 36 of this embodiment is formed by a plurality of permanent magnets, which are mounted on the circumference of the rotor 40. With its end projecting from the motor casing, the rotor 40 connects to the godet 23 of the first feed system 10.

To start up the asynchronous motor 35, a desired frequency is applied via the group frequency changer 30. After applying current to the stator winding 39, the rotor 40 is accelerated. As soon as the rotational frequency of the rotor 40 corresponds to the desired frequency, a coupling occurs between the rotating field of the stator winding 39 and the rotational frequency of the rotor 40 by means of the field magnet 36. In its operating state, the individual drive 27 performs similarly to a synchronous machine. With that, it is made sure that the desired frequency as determined by the group frequency changer 30, is automatically adjusted by the activated individual drive 27. This is important in particular for the processing units, which are arranged in the texturing machine in the form of feed systems. The yarn is thus advanced and drawn under identical conditions in each processing station.

Figure 4:
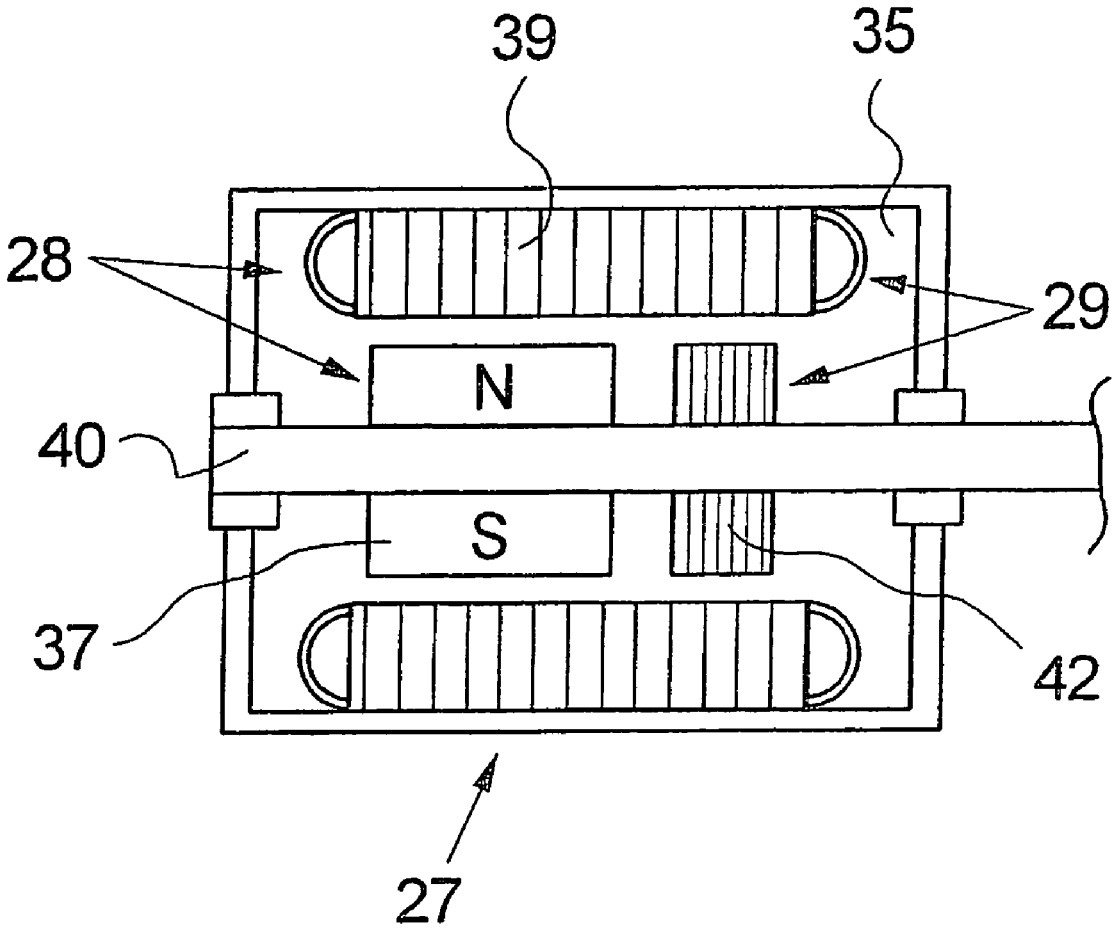
FIG. 4 is a schematic view of a further embodiment of an individual drive for a feed system.

FIG. 4 illustrates a further embodiment of an individual drive 27 with a synchronous unit 28 and an asynchronous unit 29. Components having the same function are provided with identical reference numerals. The synchronous unit 28 is formed by a synchronous motor 38. To this end, the synchronous motor 38 comprises a stator winding 39 and a rotor 40 with at least one permanent magnet 37. In this case, the rotational frequency of the rotor 40 equals the desired frequency, so that the rotor 40 rotates in sync with the rotating field of the stator winding. To enable a startup without changing the desired frequency after a shutdown of the individual drive 27, the synchronous motor 38 includes an asynchronous unit 29, which is formed by an auxiliary winding 42 on the rotor and the stator winding 39. The auxiliary winding 42 is arranged inside the stator winding 39. This ensures that the rotor 40 is accelerated with a predetermined desired frequency of the stator winding 39.

The embodiments of the individual drive as shown in FIGS. 3 and 4 are suited preferably for driving the feed systems of a texturing machine or for driving a false twist friction unit.

Figure 5:
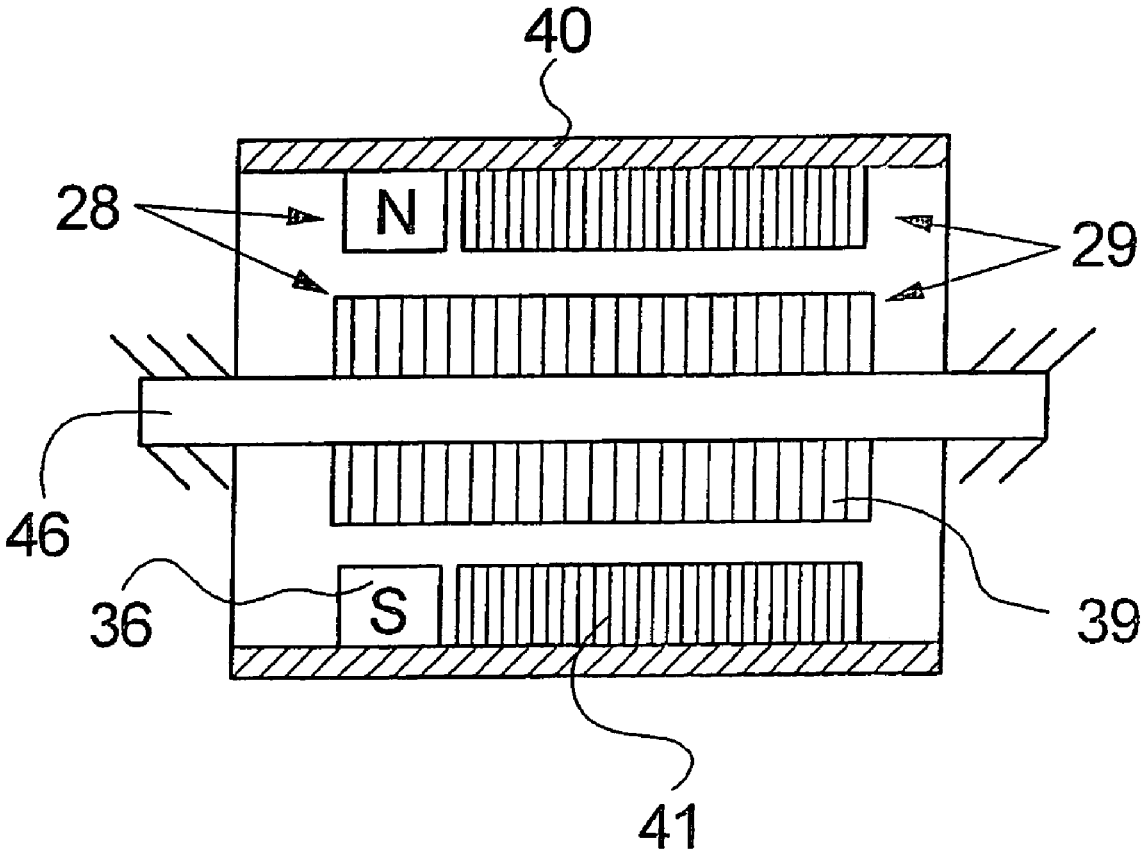
FIG. 5 shows an embodiment of an individual drive for a drive roll of a takeup device.

FIG. 5 illustrates a further embodiment of an individual drive 27, which is suited preferably for driving a drive roll 19 in a takeup device 18. To this end, the jacket of the drive roll 19 is directly driven by the individual drive 27 arranged inside the drive roll 19. For this purpose, the individual drive 27 comprises a cylindrical rotor 40. The inner side of the cylindrical rotor 40 mounts the rotor winding 41. In facing relationship with the rotor winding 41, a stationary axle 46 mounts a stator winding 39. In the axial direction, the stator winding 39 extends beyond the rotor winding 41 to cover a field magnet 36 arranged on the cylindrical rotor 40. The field magnet 36 and the stator winding 39 thus form the synchronous unit 28 of the individual drive 27. As a result of construction, the asynchronous unit 29 is provided as an asynchronous motor 35. The operation of the embodiment shown in FIG. 5 is identical with that described with reference to FIGS. 3 and 4.

Figure 2:
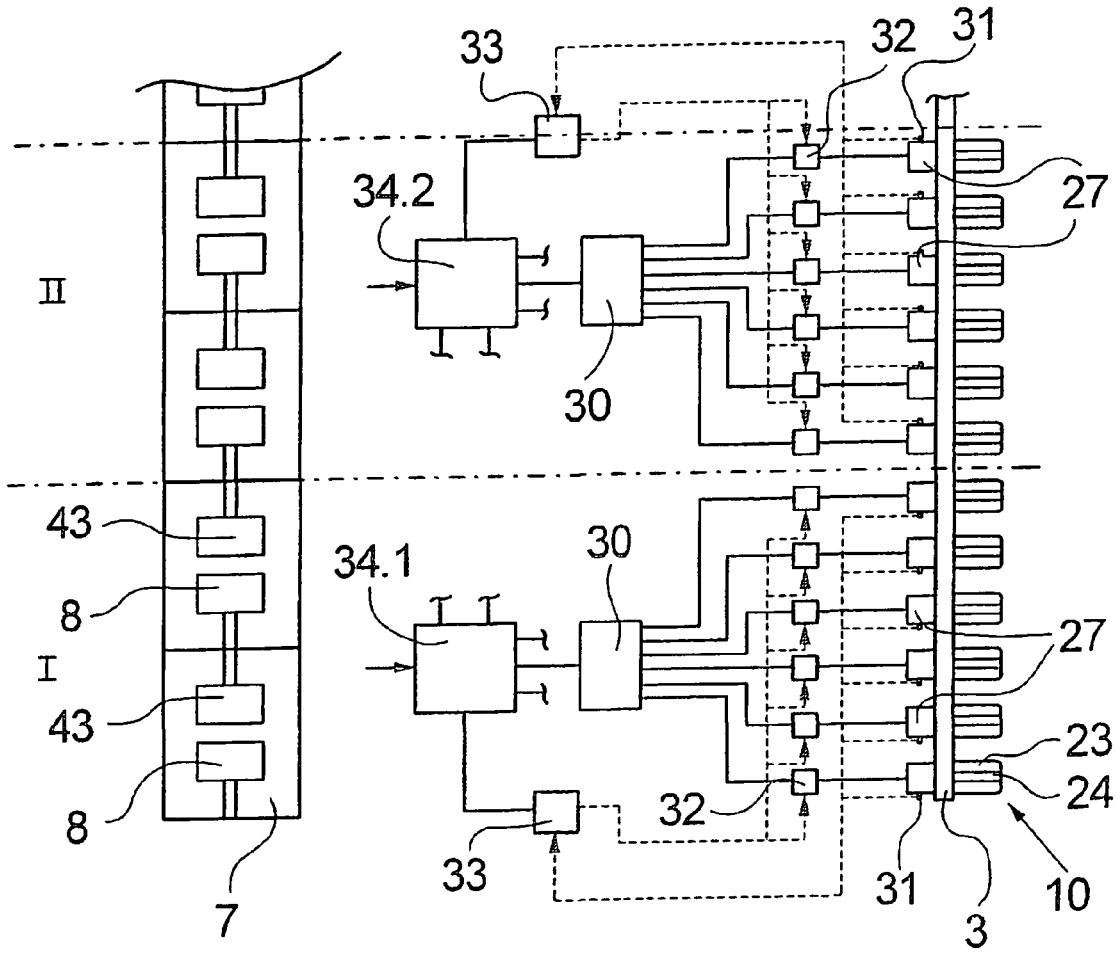
FIG. 2 is a schematic fragmentary top view of a further embodiment of a yarn texturing machine.

FIG. 2 illustrates a further embodiment of a texturing machine as a fragmentary top view thereof. The embodiment of FIG. 2 is made substantially identical with the preceding embodiment of FIG. 1. In this respect, the arrangement of the processing units within a processing station is made identical, so that the foregoing description is herewith incorporated by reference.

The top view illustrated in FIG. 2 shows only the yarn feed to the machine with creel 7 and feed module 3. The processing module 2 and takeup module 1 are not shown. As a whole, 12 processing stations are shown in side-by-side relationship. In this connection, the creel 7 accommodates in tiers the feed yarn packages 8 of three juxtaposed processing stations, with one package overlying the other, as can be noted from FIG. 1. However, for the sake of clarity, the yarn path is not shown in FIG. 2.

The feed module 3 mounts in side-by-side relationship the feed systems 10, which withdraw each yarn 36 from respectively one feed yarn package 8 of the creel 7. Each processing station is provided with one first feed system 10. Each feed system 10 comprises an individual drive 27, which is coupled with a godet 23 and a guide roll 24 associated thereto.

To control the individual drive 27, the drive connects via a switching element 32 to a group frequency changer 30. The group frequency changer 30 supplies the individual drives 27 of a total of six feed systems of a plurality of processing stations. In this connection, six processing stations form one section, which is controlled by means of a field control system 34.1 or 34.2. Thus, the group frequency changer 30 connects to a field control system 34.1 of a first section I of processing stations. Accordingly, the individual drives 27 of the feed systems 10 of a second section II are controlled via a further group frequency changer 30, which in turn is coupled with an associated field control system 34.2.

The field control systems 34.1 and 34.2 connect to additional group frequency changers or control units or drive units for controlling the processing stations.

Furthermore, the individual drives 27 of a section are associated with a control unit 33, which connects to each of the switching elements 32 associated to the individual drives 27 of a section. Each of the individual drives 27 also includes a sensor 31, which connects to the control unit 33. The control unit 33 is also coupled with the field control system 34.1 or 34.2.

The field control systems 34.1 and 34.2 and additional adjacent field control systems connect to a central machine control system (not shown).

In the texturing machine shown in FIG. 2, a group frequency changer 30 activates in the operating state, the individual drives 27 of the first feed systems 10 of each section with a predetermined desired frequency. To is this end, the field control system 34.1 or 34.2 applies both to the group frequency changer 30 and to the control unit 33, the corresponding desired frequency, which corresponds to a certain withdrawal speed of the yarns from the feed yarn packages 8. At the beginning of the process, each of the individual drives 27 is accelerated because of the asynchronous unit accommodated therein. As soon as the rotational frequency of the rotor reaches the desired frequency, the synchronous unit of the individual drives 27 maintains a predetermined circumferential speed on each of the feed systems 10.

In the case that one of the individual drives 27 shows a malfunction, which indicates an unacceptable deviation from the desired frequency, the group frequency changer 30 shuts down the particular individual drive 27 via the sensor 31, control unit 33, and switching element 32. To this end, a comparison occurs in the control unit 33 between the actual condition signaled by the sensor 31 and a desired condition that is set by the field control system 34.1 or 34.2. In the case of an unacceptable deviation of the actual condition from the desired condition, the control unit 33 activates the respective switching element 32. In this process, information is exchanged between the control unit 33 and the field control system. As soon as the malfunction is eliminated, the corresponding switching element is activated via control unit 33 for starting the individual drive. In this process, individual drives 27 adjacent the group frequency changer 30 remain unaffected in their control.

The synchronous units and asynchronous units formed in the individual drives 27 ensure an independent startup and adjustment of the desired circumferential speed on the feed systems. This achieves a great uniformity of the yarn treatment in each of the processing stations of the texturing machine without reducing the flexibility in the activation of the individual processing stations. With that, the texturing machine of the present invention combines the advantages of a group drive for processing units of the same function with the advantages of a processing station with individually driven processing units.

What is claimed is:

1. A texturing machine for false twist texturing a plurality of synthetic filament yarns comprising a plurality of side by side processing stations, with each processing station comprising a plurality of processing units for respectively advancing, texturing, drawing, and winding an advancing yarn, wherein at least one of the processing units of each processing station is driven in rotation about an axis by an electrical individual drive, wherein the individual drives of adjacent processing stations are controllable by a group frequency changer, and wherein each of the individual drives comprises an asynchronous unit for starting up the associated unit to a predetermined desired frequency and a synchronous unit for maintaining the desired frequency after start up, with the asynchronous unit and the synchronous unit having respective components which are separated from each other along said axis.

2. The texturing machine of claim 1, wherein the asynchronous unit is formed by an asynchronous motor, and wherein the synchronous unit includes a field magnet.

3. The texturing machine of claim 2, wherein the field magnet is formed by one or more permanent magnets which are arranged on a rotor of the drive.

4. The texturing machine of claim 1, wherein the synchronous unit is formed by a synchronous motor, and wherein the asynchronous unit includes an auxiliary winding on a rotor of the drive.

5. The texturing machine of claim 1, wherein the asynchronous unit comprises a stator winding and a rotor winding, and wherein the synchronous unit comprises said stator winding and one or more permanent magnets mounted on the rotor.

6. The texturing machine of claim 1, wherein each of the individual drives of the processing units of a plurality of processing stations connects via a controllable switching element to the group frequency changer.

7. The texturing machine of claim 6 further comprising a sensor for monitoring an operating parameter and for actuating the associated switching element upon sensing a yarn breakdown or the like.

8. The texturing machine of claim 6, wherein each of the individual drives is provided with a sensor for monitoring the rotational speed, and wherein the sensors and the switching elements connect to a control unit for operating the switching elements in response to a signal from the associated sensor.

9. The texturing machine of claim 8, wherein the control unit and the group frequency changer connect to a field control system which is associated to the respective processing stations.

10. The texturing machine of claim 1, wherein the individual drives of a first group of like processing units are controllable by a first group frequency changer, and the individual drives of a second group of like processing units are controllable by a second group frequency changer, and the group frequency changers connect to a central machine control system.

11. The texturing machine of claim 1, wherein the plurality of the processing stations are divided into a plurality of sections each composed of a plurality of processing stations, wherein a separate group frequency changer is connected to each of the drives of each section, and wherein each group frequency changer is connected to a separate field control system.

12. The texturing machine of claim 1, wherein for each processing station, the associated plurality of processing units is formed by a first feed system and/or a second feed system and/or a third feed system.

13. The texturing machine of claim 12, wherein at least one of the feed systems of each station is formed by a godet unit having a godet and a guide roll, with the godet being coupled with the associated individual drive.

14. The texturing machine of claim 1, wherein for each processing station, the plurality of processing units includes a drive roll of a takeup device.

15. The texturing machine of claim 1, wherein for each processing station, the plurality of processing units includes a false twist texturing unit.

16. The texturing machine of claim 1 wherein said respective components comprise a field magnet which forms part of said synchronous unit and a winding which forms part of said asynchronous unit.

17. The texturing machine of claim 16 wherein said synchronous unit and said asynchronous unit share a common winding which extends along said axis a distance sufficient to overlie both said field magnet of said synchronous unit and said winding of said asynchronous unit.

18. A texturing machine for false twist texturing a plurality of synthetic filament yarns comprising a plurality of side by side processing stations, with each processing station comprising a plurality of processing units for respectively advancing, texturing, drawing, and winding an advancing yarn, wherein at least one of the processing units of each processing station is driven by an electrical individual drive, wherein the individual drives of adjacent processing stations are controllable by a group frequency changer, wherein each of the individual drives comprises an asynchronous unit for starting up the associated unit to a predetermined desired frequency and a synchronous unit for maintaining the desired frequency after start up, and wherein each of the individual drives of the processing units of a plurality of processing stations connects via a controllable switching element to the group frequency changer.

19. The texturing machine of claim 18 further comprising a sensor for monitoring an operating parameter and for actuating the associated switching element upon sensing a yarn breakdown or the like.

20. The texturing machine of claim 18, wherein each of the individual drives is provided with a sensor for monitoring the rotational speed, and wherein the sensors and the switching elements connect to a control unit for operating the switching elements in response to a signal from the associated sensor.

21. The texturing machine of claim 20, wherein the control unit and the group frequency changer connect to a field control system which is associated to the respective processing stations.

* * * * *